US010125696B2

(12) United States Patent
Gangler et al.

(10) Patent No.: US 10,125,696 B2
(45) Date of Patent: Nov. 13, 2018

(54) CHARGE FORMING DEVICE WITH THROTTLE VALVE ADJUSTER

(71) Applicant: Walbro LLC, Tucson, AZ (US)

(72) Inventors: Bryan K. Gangler, Unionville, MI (US); Bradley J. Roche, Cass City, MI (US); Dairoku Suzuki, Cass City, MI (US); David L. Speirs, Cass City, MI (US); Eric G. Zbytowski, Caro, MI (US)

(73) Assignee: Walbro LLC, Tucson, AZ (US)

( * ) Notice: Subject to any disclaimer, the term of this patent is extended or adjusted under 35 U.S.C. 154(b) by 113 days.

(21) Appl. No.: 15/098,866

(22) Filed: Apr. 14, 2016

(65) Prior Publication Data

US 2016/0305348 A1 Oct. 20, 2016

Related U.S. Application Data

(60) Provisional application No. 62/147,295, filed on Apr. 14, 2015.

(51) Int. Cl.

| | |
|---|---|
| ***F02D 9/00*** | (2006.01) |
| ***F02D 11/06*** | (2006.01) |
| ***F02D 9/10*** | (2006.01) |
| *F02D 9/02* | (2006.01) |

(52) U.S. Cl.

CPC ..... *F02D 11/06* (2013.01); *F02D 9/105* (2013.01); *F02D 2009/0296* (2013.01); *F02D 2200/0404* (2013.01); *F02D 2400/06* (2013.01)

(58) Field of Classification Search

CPC ..... F02M 69/005; F02D 11/04; F02D 11/06; F02D 2011/101; F02D 2011/103

See application file for complete search history.

(56) References Cited

U.S. PATENT DOCUMENTS

| | | | | | |
|---|---|---|---|---|---|
| 2,766,004 | A | * | 10/1956 | Lindow | F02D 9/02 251/285 |
| 4,401,078 | A | * | 8/1983 | Kato | F02D 9/02 123/376 |
| 4,782,805 | A | * | 11/1988 | Kawano | B60K 26/04 123/403 |
| 4,962,737 | A | * | 10/1990 | Brand | F02D 9/16 123/339.15 |
| 5,131,363 | A | * | 7/1992 | Ganser | F02D 9/02 123/398 |
| 5,235,948 | A | * | 8/1993 | Grant | F02D 9/02 123/342 |
| 5,577,477 | A | * | 11/1996 | Katoh | F02B 61/045 123/456 |
| 5,777,412 | A | * | 7/1998 | Yamamoto | F02D 11/10 123/337 |

(Continued)

*Primary Examiner* — Thomas Moulis

(74) *Attorney, Agent, or Firm* — Reising Ethington P.C.

(57) ABSTRACT

In at least some implementations, a charge forming device includes a main body, a throttle valve and an adjuster. The main body includes a main bore through which fluid flows for delivery to an engine. The throttle valve is carried by the main body and moveable relative to the main bore to control fluid flow through the main bore. And the adjuster is moveable relative to the throttle valve and engageable with the throttle valve to adjust the range of motion of the throttle valve. In at least some implementations, the adjuster limits the range of motion of the throttle valve when the adjuster is engaged with the throttle valve.

20 Claims, 2 Drawing Sheets

(56) References Cited

U.S. PATENT DOCUMENTS 5,904,130 A * 5/1999 Romanelli ..... F02M 21/04 123/527
5,983,858 A * 11/1999 Hashimoto ..... F02D 9/02 123/396
6,000,683 A 12/1999 VanAllen
6,067,958 A * 5/2000 Kamimura ..... F02D 9/1065 123/337
6,173,939 B1 * 1/2001 Dottavio ..... F02D 9/1065 123/339.15
6,189,506 B1 * 2/2001 Vanderveen ..... F02D 9/10 123/337
6,202,626 B1 * 3/2001 Ito ..... F02B 31/087 123/188.14
6,202,989 B1 3/2001 Pattullo
6,286,481 B1 * 9/2001 Bos ..... F02D 9/1065 123/396
6,439,547 B1 8/2002 King et al.
6,561,496 B2 5/2003 Gliniecki et al.
6,764,062 B1 * 7/2004 Daly ..... F02D 9/10 123/337
6,945,520 B2 9/2005 Ohgane et al.
7,213,571 B2 5/2007 Sakaguchi et al.
7,261,280 B2 8/2007 Takano et al.
7,427,057 B1 9/2008 Kampman et al.
8,453,998 B2 6/2013 Pattullo et al.
8,511,650 B2 * 8/2013 Kern ..... F02M 1/02 261/52
8,857,407 B2 * 10/2014 Furuya ..... F02D 11/04 123/330
9,068,533 B2 * 6/2015 Kullik ..... F02M 1/02
9,074,535 B1 * 7/2015 Huibregtse ..... F02M 3/06
9,470,143 B2 * 10/2016 Karrar ..... F02B 63/02
9,546,636 B2 * 1/2017 Karrar ..... F02M 1/02
2003/0047167 A1 * 3/2003 Yanagii ..... F02D 9/1065 123/442
2004/0173184 A1 * 9/2004 Tanimura ..... F02D 9/1065 123/399
2004/0244769 A1 * 12/2004 Frank ..... F02D 9/1065 123/339.11
2005/0120998 A1 * 6/2005 Kobayashi ..... B21K 25/00 123/399
2006/0005809 A1 * 1/2006 Kado ..... F02D 9/1035 123/399
2006/0241843 A1 * 10/2006 Matsuda ..... B60K 28/16 701/85
2009/0241923 A1 * 10/2009 Yamagishi ..... F02B 75/22 123/579
2009/0314240 A1 * 12/2009 Maupin ..... F02M 1/02 123/179.11
2010/0116246 A1 * 5/2010 Kurita ..... F02D 9/1065 123/337
2010/0180861 A1 * 7/2010 Doering ..... F02M 1/02 123/337
2010/0212627 A1 * 8/2010 Nishimura ..... F02D 9/1065 123/337
2010/0283161 A1 * 11/2010 Hanssler ..... F02M 1/02 261/43
2012/0021659 A1 * 1/2012 Ota ..... B63H 11/113 440/41
2012/0240898 A1 * 9/2012 Lemecha ..... F02D 9/105 123/350
2014/0352660 A1 * 12/2014 Kurzenberger ..... F02D 29/00 123/400
2016/0123284 A1 * 5/2016 Prem ..... F02M 35/10255 123/337
2016/0177877 A1 * 6/2016 Ottosson ..... F02B 25/22 261/43

* cited by examiner

CHARGE FORMING DEVICE WITH THROTTLE VALVE ADJUSTER

REFERENCE TO APPLICATION

This application claims the benefit of U.S. Provisional Application No. 62/147,295 filed Apr. 14, 2015, which is incorporated herein by reference in its entirety.

TECHNICAL FIELD

The present disclosure relates generally to a charge forming device that provides air, fuel or both to an engine.

BACKGROUND

Many engines utilize a throttle valve to control or throttle air flow to the engine in accordance with a demand on the engine. Such throttle valves may be used, for example, in throttle bodies of fuel injected engine systems. Many such throttle valves include a valve head carried on a shaft that is rotated to change the orientation of the valve head relative to fluid flow in a passage, to vary the flow rate of the fluid in and through the passage. In some applications, the throttle valve is rotated between an idle position, associated with low speed and low load engine operation, and a wide open or fully open position, associated with high speed and/or high load engine operation. The idle position of the throttle valve may be set by a stop carried by the throttle body. Although the stop may be adjusted prior to use of the throttle body, for example during an initial calibration, it is not movable during use of the throttle body and thus, has only a single position in use of the throttle body.

SUMMARY

In at least some implementations, a charge forming device includes a main body, a throttle valve and an adjuster. The main body includes a main bore through which fluid flows for delivery to an engine. The throttle valve is carried by the main body and moveable relative to the main bore to control fluid flow through the main bore. And the adjuster is moveable relative to the throttle valve and engageable with the throttle valve to adjust the range of motion of the throttle valve. In at least some implementations, the adjuster limits the range of motion of the throttle valve when the adjuster is engaged with the throttle valve.

In at least some implementations, a charge forming device includes a main body, a throttle valve, a stop and an adjuster. The main body may include a main bore through which fluid flows for delivery to an engine. The throttle valve is carried by the main body and moveable between a first position and a second position relative to the main bore to control fluid flow through the main bore. The stop may be carried by the main body to engage the throttle valve and define the first position of the throttle valve, and the adjuster is moveable relative to the throttle valve and the stop and engageable with the throttle valve to adjust the range of motion of the throttle valve. The adjuster is moveable between an advanced position and a retracted position, and when the adjuster is in the advanced position, the throttle valve is prevented from moving to the first position.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 2:
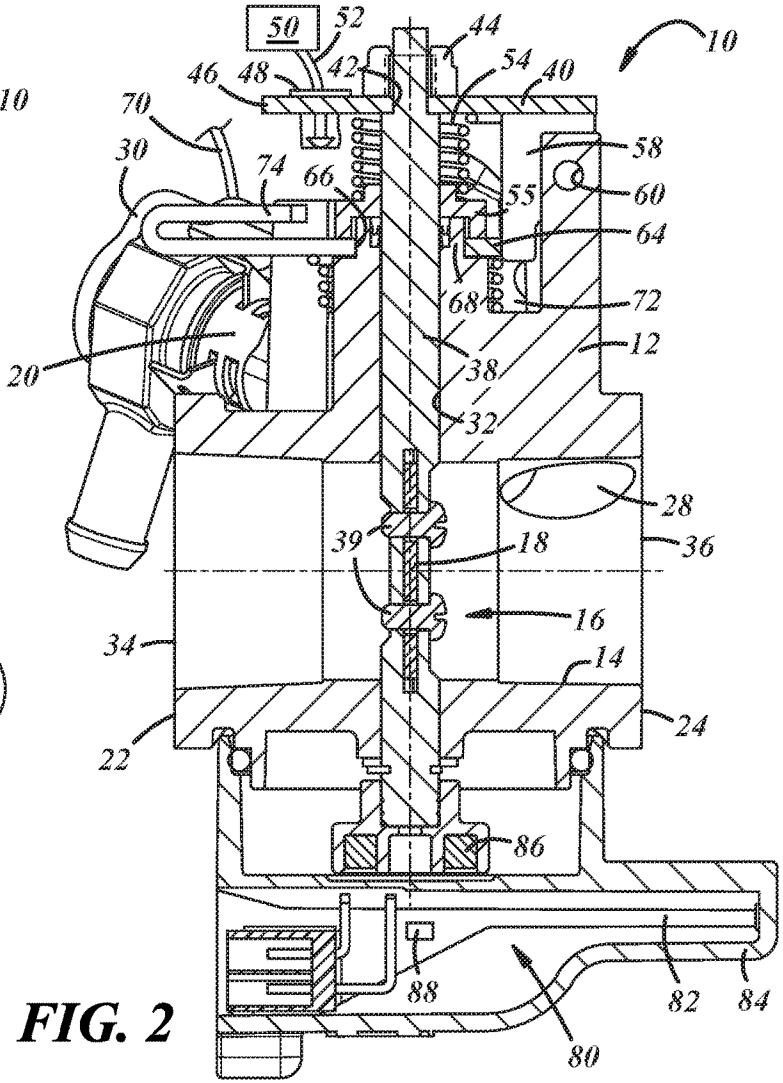
FIG. 2 is a sectional view taken along line 2-2 in FIG. 1.
Figure 1:
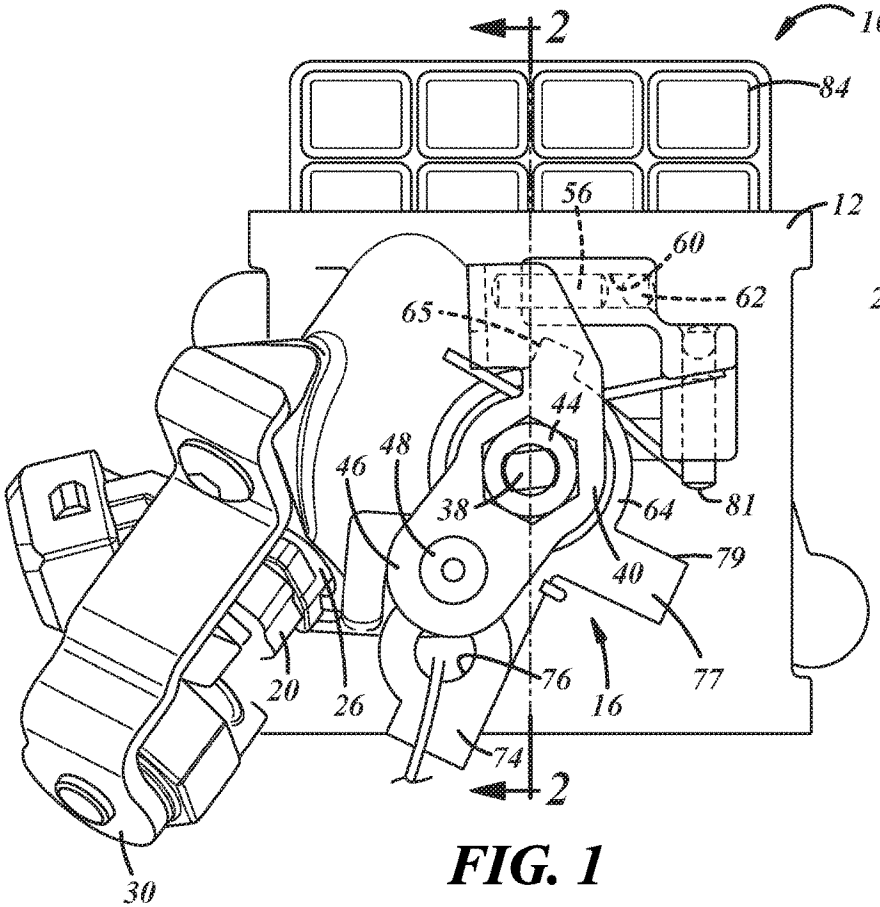
FIG. 1 is a perspective view of a throttle body.

Referring in more detail to the drawings, FIGS. 1-4 illustrate a charge forming device 10 through which fuel, air or both are provided to an engine to support combustion within the engine. In the implementation shown, the charge forming device includes a throttle body 10 having a main body 12 that has a main bore 14 through which fluid (air, fuel or both) flows. Fluid flow through the main bore 14 is controlled at least in part by a throttle valve 16, which includes a throttle valve head 18 that is movable relative to the main bore 14 to vary fluid flow rate past the valve head 18. A source of fuel may be provided into the main bore 14, or downstream thereof, to be mixed with the air and delivered to the engine as a fuel and air mixture. In the implementation shown, the source of fuel includes a fuel injector 20 through which liquid fuel is provided into the main bore 14 downstream of the throttle valve head 18. The source of fuel could also include a fuel metering chamber such as are commonly used in carburetors, or a fuel pump or other supply of fuel.

The main body 12 may be formed from one or more pieces of material and may be formed from metal or any other suitable material and by any desired process(es) such as but not limited to casting, machining or both. As shown in FIG. 2, the main bore 14 extends from an upstream side 22 of the main body 12 to a downstream side 24 of the main body 12 and may be of any size and shape desired. To mount the fuel injector 20, the main body 12 may include a mount 26 including a passage 28 that is open to the main bore 14. The fuel injector 20 may be at least partially received in the passage 28 and fuel may be provided into the passage or directly into the main bore 14. A bracket 30 may retain the fuel injector 20 on the main body 12. To mount and carry the throttle valve 16, the main body 12 may also include a throttle valve bore 32. In the implementation shown, the valve bore 32 is located between an upstream end 34 and downstream end 36 of the main bore 14 and extends through the main bore 14.

The throttle valve 16 may include a valve shaft 38 to which the valve head is coupled. The valve shaft 38 may be cylindrical and extend into and through the throttle valve bore 32 in the main body 12, and may be carried for rotation relative to the main body 12. The valve head 18 may be a butterfly type valve head including a disc formed from a suitable material (e.g. metal or plastic suitable for use with the fluid in and flowing through the main bore 14). The valve head 18 may be fixed to the valve shaft 38 in any desired way (for example, with screws 39 as shown in FIG. 2) so that the valve head 18 rotates with the valve shaft 38 between a first position and a second position. In the first position the valve head 18 may provide more resistance to fluid flow through the main bore 14 than when the valve head 18 is in its second position. In at least some implementations, the first position may be associated with idle engine operation (e.g. the lowest speed and load engine operation) and may permit a relatively low flow rate of fluid past the valve head. The second position may be associated with wide open engine operation (e.g. highest speed and/or load engine operation) and in that position, the valve head 18 permits a greater flow rate of fluid through the main bore 14. The valve head 18 may be moved to any position between the first and second positions to provide a desired fluid flow rate from the main bore 14 and to the engine.

To control rotation of the throttle valve shaft 38 and valve head 18, the throttle valve 16 may include a throttle lever 40 coupled to the valve shaft 38 and accessible from outside of the main body 12. In the implementation shown, the throttle lever 40 includes a non-circular opening 42 (FIG. 2) received over a complementarily shaped portion of the valve shaft 38 and secured thereto by an overlying nut 44. Of course, other arrangements are possible to couple the lever 40 and valve shaft 38 together. A tab 46 extending from the throttle lever 40 may include a coupler 48 or otherwise be coupled to an actuator 50 (shown diagrammatically in FIG. 2) that provides a force on the throttle lever 40 to rotate the valve shaft 38. In at least some implementations, a control cable 52 is coupled to the tab 46 and is operable to rotate the throttle valve 16 from its first position toward or to its second position. A return actuator 54 may automatically return the throttle valve 16 to its first position when the cable 52 is not providing a force acting on the throttle lever 40. The return actuator may be a spring 54 or other mechanism that yieldably biases the throttle valve 16 toward its first position when a greater force is not rotating the throttle valve 16 away from its first position. In the implementation shown, the spring 54 is received around a collar 55 that surrounds part of the valve shaft 38, one end of the spring 54 bears on the throttle lever 40 and the other end of the spring bears on collar 55 that bears on the main body 12 to rotatably bias the throttle valve 16 toward its first position. Of course, other actuators can be used and the cable and spring implementation is not limiting to the possibilities of actuators. The actuators may include, again without intending to limit disclosure to any particular implementation, one or more solenoids, servomotors, springs or other devices or manually manipulated levers, dials or the like.

Figure 3:
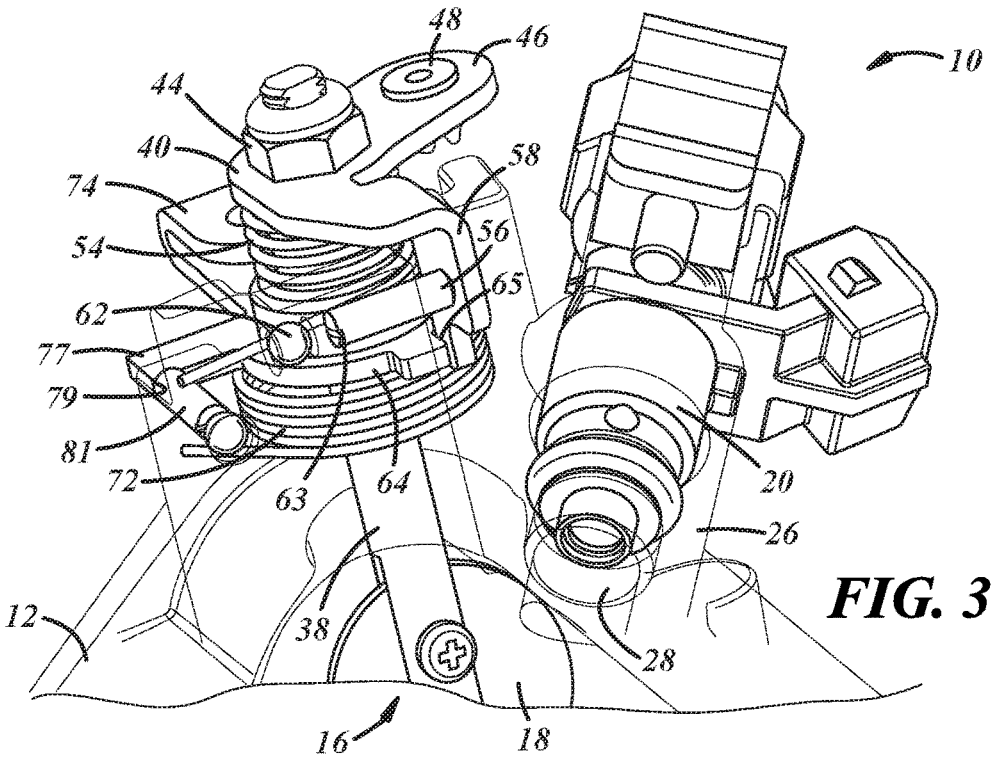
FIG. 3 is a fragmentary perspective view of the throttle body with a main body shown as transparent to show an internal throttle valve head in a first position.
Figure 4:
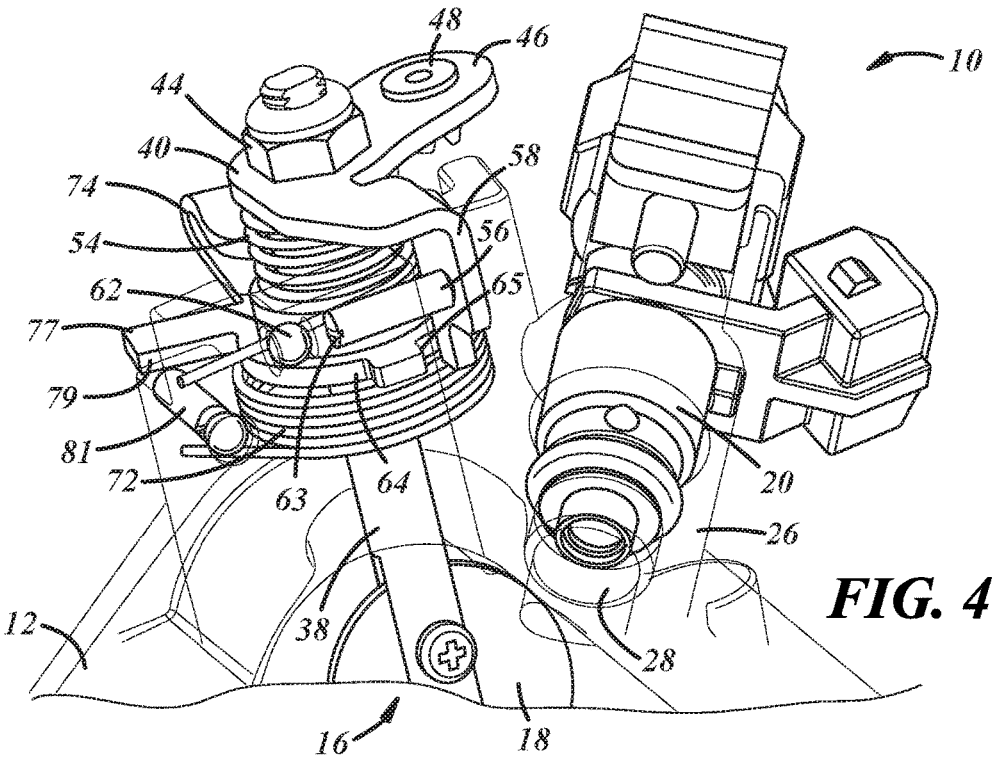
FIG. 4 is a fragmentary perspective view like FIG. 3 showing the throttle valve head in a second position.

The first position of the throttle valve 16 may be defined by a stop or stop surface 56 carried by or formed on the main body 12 (e.g. a separate component coupled to the main body 12 or a feature defined integrally in the main body 12 itself). In the implementation shown, the stop surface is defined by a pin 56 carried by the main body 12 and extending outwardly therefrom in the path of rotation of the throttle valve 16. In this example, the pin 56 is in the path of rotation of a finger 58 of the throttle lever 40 and is adapted to be engaged by the throttle lever 40 to positively define the first position of the throttle valve 16. The finger 58 may extend at an desired angle from a base of the throttle lever 40, and the stop 56 may be adjustable to vary the angular position of the throttle valve 16 in the first position as desired. The position of the stop 56 may be calibrated for a particular carburetor or throttle body and then the position can be locked in place, if desired. In the implementation shown, the pin 56 is threaded and engaged with threads in a bore 60 (FIGS. 1 and 2) of the main body 12 so that the pin 56 may be advanced and retracted by rotating the pin 56 relative to the main body 12. To this end, the pin 56 may include a drive feature 63 (e.g. a slot as shown in FIGS. 3 and 4) to be engaged by a tool for rotation of the pin 56, and access to the drive feature 63 may be prevented after the position of the pin 56 is set, such as by insertion of a plug 62 into the bore 60 in which the pin 56 is received. Of course, the pin 56 may be adjustable to permit tuning of the throttle body 10 after assembly and use on an engine, if desired.

A valve adjuster 64 may be associated with the throttle valve 16 to permit selective control of the throttle valve 16 position. In at least some implementations, the valve adjuster 64 may establish a third position of the throttle valve 16 at least for a certain duration of time, or based on some parameter other than time. The third position of the throttle valve 16 may be between the first position and the second position of the throttle valve 16 to provide the throttle valve 16 in a more open position than the first position at idle/low speed and low load operation, and thereby permit a greater fluid flow rate through the main bore 14. In at least some implementations, the third position of the throttle valve 16 is rotationally closer to the first position than the second position and defines an off-idle or fast-idle position for the throttle valve 16. Hence, when the valve adjuster 64 is actuated the throttle valve 16 may rotate between the third and second positions, and the throttle valve 16 in at least some implementations does not rotate all the way back to the first position until the adjuster 64 is released or not actuated. Some situations where it may be desirable to operate the throttle valve 16 between the third and second positions include (but are not limited to) during starting of a cold engine and during operation of the engine at higher altitudes where increased air flow rates may be desirable.

In at least some implementations the adjuster 64 may include or be defined by a secondary lever carried by the throttle body for selective engagement with the throttle lever 40. The adjuster 64 may engage any part of the throttle lever 40, or any other part of the throttle valve 16 suitable to control the lowest speed/load position of the throttle valve 16, and in the example shown the adjuster 64 includes a stop surface 65 that engages the throttle lever finger 58 which in turn engages the stop 56 to define the first position of the throttle valve 16. The adjuster 64 may be rotatable relative to the valve shaft 38 and throttle lever 40 and in at least some implementations, the adjuster 64 is not rotated as the throttle valve 16 rotates. While shown in FIG. 2 as having an opening 66 received around a boss 68 of the main body 12 and also surrounding the valve shaft 38, the adjuster 64 could be separate from the valve shaft 38 and simply pivoted about the main body 12, or otherwise carried by the throttle body 10 or an adjacent structure so that it is capable of selective adjustment of the throttle valve 16 position.

The adjuster 64 may be actuated separately from the throttle valve 16, and by a separate actuator 70. In at least some implementations, the actuator may include a lever or cable 70 actuated by a person operating the engine (or a device including the engine). The lever or cable 70 may be separate from the actuator(s) that rotates the throttle valve 16 between its first, second and/or third positions. In this way, the adjuster 64 may be moved from a retracted position to an advanced position independently of any rotation of the throttle valve 16, and the adjuster 64 can be maintained in a desired position without being affected by throttle valve 16 rotation. In the retracted position, shown in FIG. 4, the adjuster 64 does not engage or interfere with the throttle valve 16 and the throttle valve 16 may be moved between its first and second positions. In the advanced position, shown in FIG. 3, the adjuster 64 inhibits or prevents movement of the throttle valve 16 to the first position and limits movement of the throttle valve 16 to a range including the second and third positions.

In other words, in the advanced position the adjuster 64 engages the throttle valve 16 before the stop 56 as the throttle valve 16 rotates toward its first position, and prevents the throttle valve 16 from rotating beyond its third position. To return the adjuster 64 to its retracted position, the same actuator 70 may be moved to its starting position which may actively drive the adjuster 64 to its retracted position (i.e. the actuator may positively move the adjuster 64 between both advanced and retracted positions), and/or a return actuator 72, such as a spring, may provide a force on the actuator to return the adjuster to its retracted position (i.e. the actuator 70 only drives the adjuster 64 from its retracted to its advanced position and a different actuator 72 provides the return movement of the adjuster from its advanced position to its retracted position). In the implementation shown, the adjuster 64 includes a hook 74 and eyelet 76 to receive the end of the cable 70, and also includes a return spring 72 that has one end bearing on the adjuster 64 and the other end bearing on the main body 12 to yieldably bias the adjuster 64 toward its retracted position.

To permit control of the rotary location where the stop surface 65 engages the finger 58 and hence defines the third position of the throttle valve 16, the adjuster 64 may include a tab 77 with a stop or stop surface 79 adapted to engage a stop 81 of the throttle body 10 (or an adjacent structure). The stop 81 may be adjustable, if desired, and is shown as being defined by a pin threadedly carried by the main body 12 like the pin 56 already described.

In at least some implementations, the throttle valve 16 may be associated with a throttle position sensor 80 (FIG. 2) that provides an indication of the instantaneous throttle valve 16 position. Such a sensor 80 may provide the throttle valve 16 position information to a controller 82 that, for example, calculates an amount of fuel to provide from the fuel injector 20 for operation of the engine at a given throttle valve position. The throttle valve 16 position information may also be used for other purposes, such as to facilitate control of the timing of an ignition pulse from a spark plug, among other things. In the implementation shown, the throttle position sensor 80 and controller 82 are carried at least partially in a housing 84 that is coupled to the main body 12. The throttle position sensor 80 may include one or more magnets 86 coupled to the throttle valve 16 for rotation with the throttle valve 16, and a sensor 88 responsive to the rotary location or position of the magnets 86.

With such information regarding instantaneous throttle valve 16 position, the controller 82 and system generally may learn or be programmed or otherwise responsive to one or more particular or calibrated positions of the throttle valve 16. For example, the first and third positions may be calibrated for each throttle body 10 after assembly of the throttle body 10 to provide a desired engine operation when the throttle valve 16 is in those positions. The calibrated positions may be stored in memory associated with the controller 82 and certain engine operational parameters can be controlled as a function of these known positions. Further, actuation of the adjuster 64 can be sensed or otherwise determined so that the associated throttle valve 16 movement is not interpreted as an acceleration of the engine which may otherwise cause undesired or unnecessary fuel and/or ignition timing changes. Further, if a clutch is used with a tool driven by the engine (e.g. a clutch for the cutting chain of a chainsaw), engagement or actuation of the clutch can be avoided if/when desired by setting the third position below a clutch engagement speed or by the controller when it is determined that the adjuster 64 is actuated or advanced. This may prevent or inhibit unintended actuation of the tool associated with the engine. Accurately setting a desired third position may be facilitated when the third position is determined or set after assembly of the throttle body onto the engine as tolerances in the various components and assemblies can be accounted for after assembly to ensure the third (e.g. fast idle) position of the throttle valve is below a threshold level (e.g. below the speed at which the clutch is actuated or engaged).

In this way, the adjuster 64 may be moved and actuated separately from the throttle valve 16, and is operable to change an initial or idle position of the throttle valve 16 from a first position to a third position. In at least some implementations, the third position is closer to a wide open throttle position than is the first position, although this is not necessary. The adjuster 64 may be used temporarily during a period of engine operation (e.g. to facilitate starting and warming-up a cold engine) or for the entire engine operation (e.g. to facilitate engine operation at higher altitudes than that for which the engine was calibrated). In this way, the engine may be operated in two modes: a first mode wherein the throttle valve 16 may move between a first position and a second position; and a second mode wherein the throttle valve 16 may move between a third position and the second position.

In at least some implementations, the third position may be offset from the first position by about 0.25 to 20 degrees of rotation of the throttle valve 16, which results in the throttle valve 16 being more open when in the third position than when in the first position. In at least some charge forming devices, in the first position, the throttle valve 16 might be rotated 5-8 degrees relative to a plane that is perpendicular to the axis of the main bore 14 so that the throttle valve 16 is slightly open relative to the main bore 14 and fluid may flow through the main bore 14. Therefore, in the third position, the throttle valve 16 may be rotated about 8 to 20 degrees or so relative to that plane so that the throttle valve 16 is more open and a greater fluid flow rate is permitted through the main bore 14.

In use, when the engine is operating air flows into the upstream end 34 of the main bore 14 and around the throttle valve head 18 within the bore 14. Fuel is discharged from the fuel injector 20 into the passage 28 which intersects with the main bore 14 downstream of the throttle valve 16 (in the implementation shown). The fuel from passage 28 is mixed with the air flowing through the main bore 14 and a fuel and air mixture is discharged from the downstream end 36 of the main bore 14 and is delivered to the engine. The flow rate of air is controlled at least in part as a function of the throttle valve position, and the flow rate of fuel is controlled to provide a desired air:fuel ratio in the fuel and air mixture delivered to the engine. When desired, the adjuster 64 may be moved from its retracted position to its advanced position. At that time, if the throttle valve 16 is in its first position, the adjuster will engage the throttle valve (via surface 65) and rotate the throttle valve to its third position. Thereafter, while the adjuster is in its advanced position, the throttle valve is prevented from returning to its first position and instead is limited to rotation between the second and third positions as noted above.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A charge forming device, comprising:

a main body including a main bore through which fluid flows for delivery to an engine, and a stop carried by or formed on the main body;

a throttle valve carried by the main body and moveable relative to the main bore to control fluid flow through the main bore, the throttle valve is movable between a first idle position in which a first portion of the throttle valve engages the stop and a second wide open throttle position wherein the first portion of the throttle valve is spaced from the stop; and an adjuster moveable relative to the throttle valve and relative to the stop and engageable with the throttle valve to adjust the range of motion of the throttle valve wherein the adjuster is moveable from a retracted position wherein the throttle valve may move between the first position and the second positions, and an advanced position wherein the throttle valve may move between the second position and a third position spaced from the first and second positions.

2. The device of claim 1 wherein the range of motion of the throttle valve is greater when the adjuster is in the retracted position.

3. The device of claim 1 wherein the third position is closer to the second position than the first position.

4. The device of claim 1 which also comprises a fuel injector carried by the main body and through which fuel is injected into air flowing through the main bore.

5. The device of claim 1 wherein the throttle valve includes a valve shaft and a throttle lever coupled to the valve shaft for rotation with the valve shaft, and wherein the adjuster when in an advanced position engages the throttle lever to reduce the range of movement of the throttle lever.

6. The device of claim 5 wherein the adjuster when in the advanced position engages the throttle lever when the throttle valve rotates toward the idle position and before the throttle valve reaches the idle position so that the throttle valve cannot be rotated to the idle position when the adjuster is in the advanced position.

7. A charge forming device, comprising:

a main body including a main bore through which fluid flows for delivery to an engine;

a throttle valve carried by the main body and moveable relative to the main bore to control fluid flow through the main bore;

the throttle valve includes a valve shaft and a valve lever coupled to the valve shaft for rotation with the valve shaft;

and the throttle valve has an idle position and a wide open position;

a stop carried by the main body and engageable with a first portion of the throttle valve lever when the throttle valve is in the idle position and not engaged by the first portion of the throttle valve lever when the throttle valve is in the wide open position; and an adjuster movable independently of and relative to the throttle valve to adjust the range of motion of the throttle valve; and the adjuster when in an advanced position engages the throttle valve lever when the throttle valve rotates toward the idle position and before the throttle valve reaches the idle position so that the throttle valve cannot be rotated to the idle position when the adjuster is in the advanced position and the adjuster is capable of remaining in the advanced position even when the throttle valve lever is not engaged with the adjuster.

8. The device of claim 7 wherein the adjuster and the stop are separate from each other and the adjuster is movable relative to the stop.

9. A charge forming device, comprising:

a main body including a main bore through which fluid flows for delivery to an engine, and a first stop;

a throttle valve carried by the main body and moveable relative to the main bore to control fluid flow through the main bore, the throttle valve engaging the first stop to define a first position of the throttle valve;

an adjuster moveable independently of and relative to the throttle valve and engageable with the throttle valve to adjust the range of motion of the throttle valve;

the adjuster is movable from a retracted position wherein the throttle valve may move between a first position and a second position and an advanced position wherein the throttle valve may move between a third position and the second position; and a second stop carried by the main body and arranged to engage the adjuster when the adjuster is in the advanced position to define the advanced position of the adjuster and the third position of the throttle valve.

10. The device of claim 9 wherein the second stop is adjustable so that the location of the advanced position of the adjuster may be adjusted.

11. A charge forming device, comprising:

a main body including a main bore through which fluid flows for delivery to an engine;

a throttle valve carried by the main body and moveable between a first position and a second position relative to the main bore to control fluid flow through the main bore, a stop carried by the main body to engage the throttle valve and define the first position of the throttle valve; and an adjuster moveable relative to the throttle valve and the stop and engageable with the throttle valve to adjust the range of motion of the throttle valve, the adjuster being moveable between an advanced position and a retracted position and when the adjuster is in the advanced position, the throttle valve is prevented from moving to the first position.

12. The device of claim 11 wherein the adjuster is moveable from a retracted position wherein the throttle valve may move between a first position and a second position, and an advanced position wherein the throttle valve may move between a third position and a second position and the third position is closer to the second position than is the first position.

13. The device of claim 11 wherein the range of motion of the throttle valve is greater when the adjuster is in the retracted position.

14. The device of claim 11 which also comprises a fuel injector carried by the main body and through which fuel is injected into air flowing through the main bore.

15. The device of claim 11 wherein the throttle valve includes a valve shaft and a throttle lever coupled to the valve shaft for rotation with the valve shaft, and wherein the adjuster when in an advanced position engages the throttle lever to reduce the range of movement of the throttle lever.

16. The device of claim 15 wherein the throttle valve has an idle position and a wide open position and the adjuster when in the advanced position engages the throttle lever when the throttle valve rotates toward the idle position and before the throttle valve reaches the idle position so that the throttle valve cannot be rotated to the idle position when the adjuster is in the advanced position.

17. The device of claim 11 which also includes a stop carried by the main body and arranged to engage the adjuster when the adjuster is in the advanced position.

18. The device of claim 17 wherein the stop is adjustable so that the location of the advanced position of the adjuster may be adjusted.

19. The device of claim 11 wherein when the adjuster is in the advanced position the throttle valve may move between a third position and the second position, and the third position is selected as a function of the engine with which the charge forming device is used to maintain the engine speed below a threshold level for actuation of a clutch associated with the engine and when the throttle valve is in the second position the engine speed will be greater than the threshold level.

20. The device of claim 11 which also comprises a throttle valve position sensor that senses and provides an indication of the instantaneous position of the throttle valve.

* * * * *